US008088328B2

(12) United States Patent
Jones

(10) Patent No.: US 8,088,328 B2
(45) Date of Patent: Jan. 3, 2012

(54) VACUUM NITRIDING FURNACE

(76) Inventor: William R. Jones, Souderton, PA (US)

( * ) Notice: Subject to any disclaimer, the term of this patent is extended or adjusted under 35 U.S.C. 154(b) by 769 days.

(21) Appl. No.: 12/157,768

(22) Filed: Jun. 13, 2008

(65) Prior Publication Data

US 2009/0309277 A1 Dec. 17, 2009

(51) Int. Cl.
*C21D 1/06* (2006.01)
*C21D 1/74* (2006.01)

(52) U.S. Cl. ..... 266/252; 266/250; 148/216; 432/247

(58) Field of Classification Search ..... 266/205, 266/249–264; 432/247, 200–205; 148/216
See application file for complete search history.

(56) References Cited

U.S. PATENT DOCUMENTS

| | | | | |
|---|---|---|---|---|
| 2,032,209 | A * | 2/1936 | Harsch | 266/252 |
| 3,140,205 | A | 7/1964 | Malcolm | |
| 3,150,226 | A * | 9/1964 | Thorne et al. | 373/130 |
| 4,264,380 | A * | 4/1981 | Rose et al. | 148/230 |
| 4,325,694 | A * | 4/1982 | Bergman | 432/247 |
| 4,417,927 | A | 11/1983 | Fullman | |
| 4,770,630 | A * | 9/1988 | Akimoto et al. | 432/121 |
| 4,904,316 | A | 2/1990 | Dawes et al. | |
| 5,114,500 | A | 5/1992 | Tahara et al. | |
| 5,186,764 | A * | 2/1993 | Stiasny | 148/206 |
| 5,271,545 | A | 12/1993 | Boswell et al. | |
| 6,023,487 | A * | 2/2000 | Jones | 373/130 |
| 6,042,370 | A * | 3/2000 | Weide | 432/103 |
| 6,756,566 | B2 | 6/2004 | Moller | |
| 2006/0119021 | A1 | 6/2006 | Edenhofer | |

FOREIGN PATENT DOCUMENTS

| | | |
|---|---|---|
| EP | 754768 | 10/2001 |
| GB | 1277846 | 4/1970 |
| WO | WO2006/105899 | 10/2006 |

OTHER PUBLICATIONS

George E. Totten et al.; Handbook of Metallurgical Process Design; Marcel Dekker Inc.; New York, NY, May 2004; p. 579.
YA. I. Matin; V.P. Vologdini All Union Scientific-Research Institute of High-Frequency Current, Translated from Metallovendeniei. Termicheskaya Obrabotka Metallov, No. 3, pp. 42-46, Mar. 1974.

* cited by examiner

*Primary Examiner* — Scott Kastler
*Assistant Examiner* — Michael Aboagye
(74) *Attorney, Agent, or Firm* — Aaron Nerenberg

(57) ABSTRACT

A heat treating furnace is disclosed for nitride case hardening and gas cooling a stationary workload in the same furnace which is comprised of a single chamber and an access door. The chamber is segregated into an outer portion and an inner portion, with the inner portion being adapted to receive the workload to be nitride case hardened through the access door. The inner portion is surrounded by graphite insulation to retain the gas used to nitride case harden the workload. The inner portion further includes a plurality of graphite resistance heating elements and a plurality of graphite plates juxtaposed in near proximity to the graphite resistance heating elements forming a conduit or plenum between them. The inner portion further includes a fan assembly including a graphite radial fan wheel adapted to circulate the nitriding gas within the inner portion and through the conduit to provide uniform nitride case hardening of the workload.

13 Claims, 6 Drawing Sheets

VACUUM NITRIDING FURNACE

BACKGROUND OF THE INVENTION

1. Field of the Invention

The present invention relates to a horizontal, front loading vacuum heat treating furnace that is equipped to nitride or case harden materials by the addition of nitriding gases during the heat cycle, and to rapidly cool the hardened materials by external gas cooling at positive pressures in a single chamber of the furnace.

2. Description of the Prior Art

Typical nitriding furnaces presently in use are pit type furnaces or, in some cases, horizontal furnaces containing an inconel or other steel alloy retort which holds the workload during the heat treatment cycle. Over time inconel and other steel alloy retorts will dissociate the ammonia, resulting in the creation of surface nitrides and altering the desired nitriding potential of the process. Inability to accurately maintain a constant nitriding potential leads to poor quality nitrided parts. The present invention does not utilize such a steel alloy retort or refractory chamber. The vacuum nitriding furnace according to the present invention utilizes all graphite internal parts in the hot zone which are inert to the nitriding and corrosive nature of the preferred processing gas-anhydrous ammonia. The absence of reactive alloys in the furnace retort chamber results in the workload being the only source for ammonia dissociation and provides the nascent nitrogen required to produce the nitrided case in the workload material.

While the present furnace is capable of maintaining vacuum pressures as low as $1\times10^{-2}$ torr, it is designed to maintain a slightly positive pressure during the nitriding cycle and includes new and improved mechanisms to ensure even heating and uniform gas flow throughout the process. The furnace is also designed with the capability to rapidly cool the workload at atmospheric pressure in the same furnace chamber.

In typical prior art vacuum furnaces, such as disclosed in EPO 754768, a single chamber vacuum furnace is described as being formed on the interior as a chamber within a chamber. A single internal circulation fan is located on the furnace door within an outer chamber for circulating the cooling gas. Actuated gas delivery units contain a series of flapper nozzles that open to allow gas to flow into the interior chamber through closeable openings, and then close as the pressure builds. This structural design and the method described allow the introduction of cooling gas closer to the top of the workload. As the cooling gas becomes stagnant, the lower portals, which are closed during the heating cycle, are opened to allow the hot gas to exit into the gas recirculation chamber to be cooled and recirculated. There is no mention of the materials used in the heating chamber, nor is there any recognition of the unique problems associated with gas nitriding of materials.

Another example of a vacuum furnace having a convection heating system is described in U.S. Pat. No. 6,756,566. The furnace includes a hot zone and a plurality of gas injection nozzles for injecting a cooling gas into the heat treatment zone of the furnace. Each gas injection nozzle includes a flapper, or gas exit port, having a nozzle designed to allow inward flow of gas during cooling, but to impede outward flow during the heating cycle. The furnace has an outer chamber and an inner chamber within the outer chamber. The inner chamber hot zone enclosure is lined internally with a refractory material to resist the intense processing heat.

Both designs described in these prior art patents are subject to potential gas leakage during the heating cycle due to their inability to maintain a completely positive seal. Thus both designs can cause thermal gradients within the hot zone during processing and can result in non-uniform core hardness of the workload. Neither design includes the unique graphite baffling arrangement in the hot zone, as disclosed in the present invention, resulting in uniform core hardness of the workload.

SUMMARY OF THE INVENTION

These and other deficiencies of the prior art are overcome by the present invention. In one of its aspects this invention provides a heat treating furnace for nitride case hardening and gas cooling a stationary workload in the same furnace, comprising a single chamber and access means, the chamber being segregated into an outer portion and an inner portion, with the inner portion being adapted to receive the workload to be nitride case hardened through the access means and further being surrounded by graphite insulation means to retain gas used to nitride case harden the workload, the inner portion further including a plurality of graphite resistance heating elements and a plurality of graphite plates juxtaposed in near proximity to the graphite resistance heating elements forming a conduit therebetween, the inner portion further including fan assembly means adapted to circulate the nitriding gas within the inner portion and through the conduit to provide uniform nitride case hardening of the workload.

DETAILED DESCRIPTION OF THE INVENTION

Figure 1:
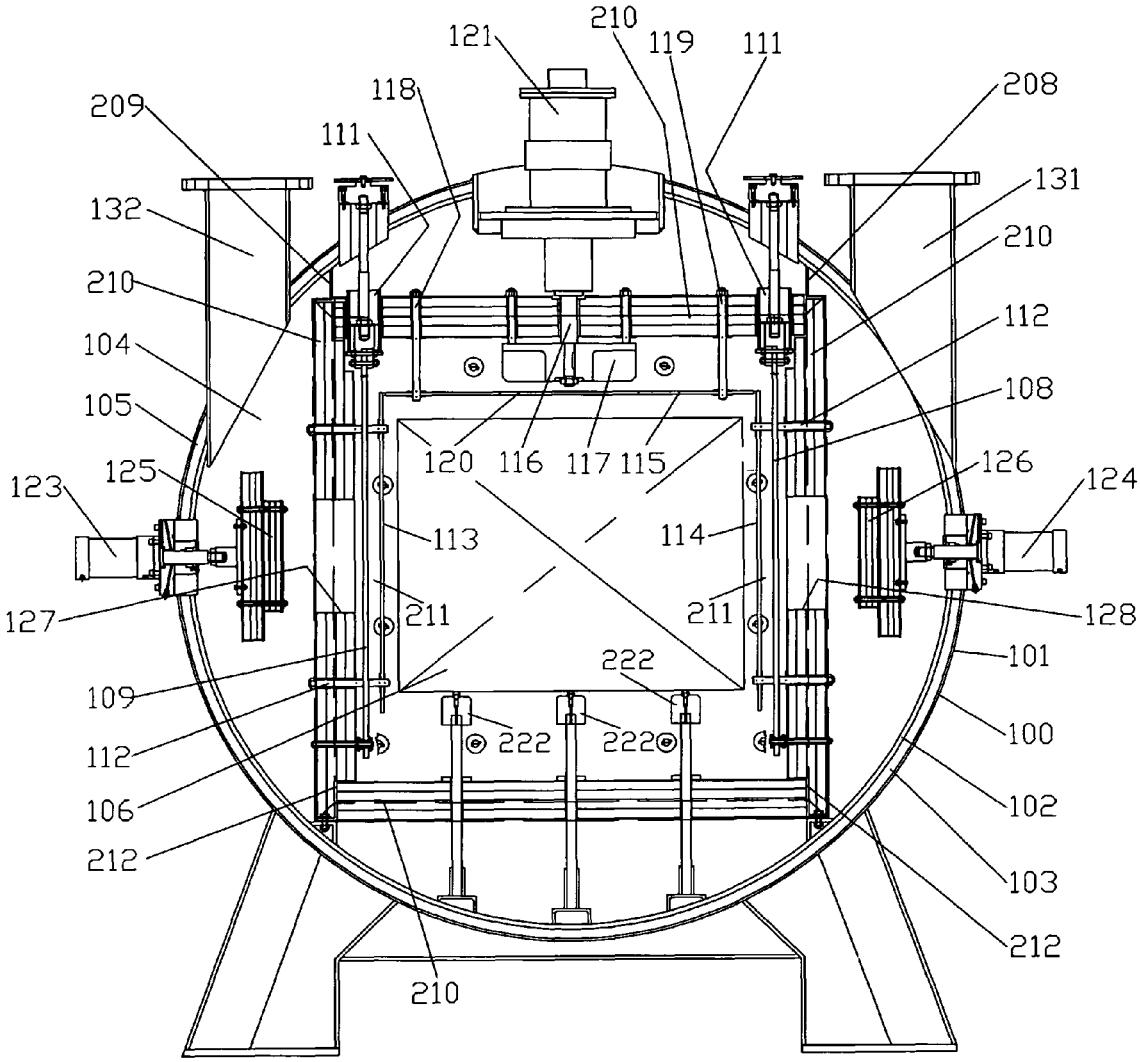
FIG. 1 depicts in perspective a partial front, open door cross-section view of a vacuum nitriding furnace 100.
Figure 2:
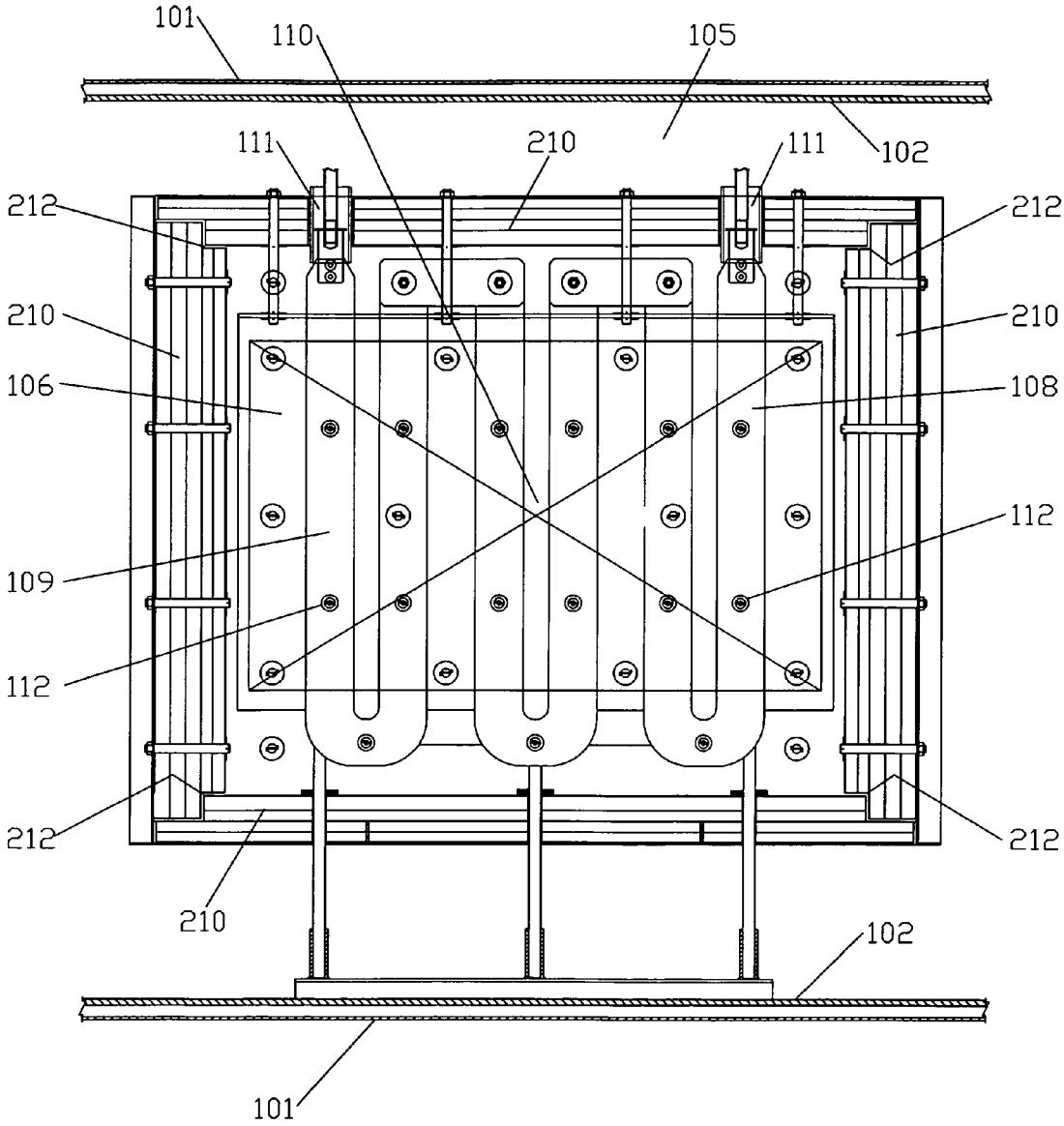
FIG. 2 depicts in partial side view cross-section the front hot zone or treatment end of furnace 100.

Referring to the drawings wherein like reference numerals refer to the same or similar elements across the multiple views, FIG. 1 depicts a partial front, cross-section view in perspective (looking toward the door end) of a high temperature vacuum nitriding furnace 100. Outer furnace wall 101 and inner wall 102 of furnace 100 form the radial boundaries of a furnace water jacket 103 used for cooling the furnace. The outer chamber 104 of furnace 100 thus is a cylindrical double walled, water-cooled vessel, and is typically manufactured from low carbon steel such as 304 stainless steel. All flanges are similarly machined from low carbon steel. The width of water jacket 103 is approximately 1 inch maximum, with large oversized water inlet and exit ports (not shown) located around the chamber to allow for convenient periodic flushing of the water jacket to reduce sediment build-up. Inner wall 102 also forms the outer wall of a spacious gas plenum chamber 105 (see FIG. 2), a large annular cavity that is important to high velocity (very rapid) cooling.

Within gas plenum chamber 105 is a hot zone 106 of vacuum nitriding furnace 100. The hot zone is generally of a rectangular design and consists of all graphite materials. There are no steel alloys utilized within the hot zone according to the present invention, as is found in prior art nitriding furnaces such as shown and described in U.S. Pat. Nos. 4,904,316, 4,417,927 and 3,140,205, as well as in Handbook of Metallurgical Process Design by George E. Totten et al., Marcel Dekker Inc., New York, N.Y., May 2004; page 579. The interior of outer chamber 104 is painted with a high temperature, non-volatile epoxy paint which is inert to the ammonia gas that is used in the nitride heat treating process. All chamber exit ports for ancillary equipment such as power terminals, vacuum pumping ports, and gas quench systems are sealed with "o-rings" (not shown) manufactured from materials inert to ammonia gas.

Hot zone 106 includes a work zone 110 (shown in FIG. 2) for nitride heat treating of a workload placed in the furnace. Hot zone 106 is preferably 36 inches wide×30 inches high×48 inches deep, allowing large workloads to be nitride heat treated to relatively and predictively precise tolerances within ±10° F. It should be understood that the dimensions of the hot zone could be advantageously varied and still remain in keeping with the spirit and scope of the present invention. Hot zone 106 is manufactured entirely from graphite materials, which are inert to anhydrous ammonia used in the nitride heat treating process.

The structure surrounding hot zone 106, including outer wall 101 and inner wall 102, is manufactured preferably from 304 stainless steel. The hot zone 106 is in the form of a reinforced rectangular box completely surrounded by a plurality of layers of commercially available high purity graphite felt insulation 210 forming a thick (typically 2 inches) graphite shield around hot zone 106. The layers of graphite insulation 210 are lapped at all four corners (shown as 212) to prevent leakage of cool gas into the hot zone during the heating cycle. Each of the front and rear interior surfaces of the furnace (not shown) are also completely insulated with a graphite felt insulation layer. The graphite felt insulation layers 210 surrounding hot zone 106 are further reinforced against wear and gas erosion with a heavy duty graphite foil composite hot face material (not shown), such as 0.040 thick Flex Shield hot face, which is well know in the industry. Plates 208 and 209 extend from the outside surface of graphite insulation 210 to inner wall 102 in order to further seal the leakage of gas within inner chamber 104. This design results in a substantially leak-proof rectangular hot zone configuration within a circular vacuum chamber.

As shown in FIG. 1, there are two flat, low mass graphite band elements 108 and 109 located within graphite insulated hot zone 106. These graphite resistance heating elements provide rapid, uniform radiant heating, and cool down rapidly. Graphite heating elements 108 and 109 are attached to power terminals 111 at the top of hot zone 106 and are supported by standoff assemblies 112 that are designed to shield the ceramic insulators (not shown) from the build up of metal plating, which can result in unwanted arcing and electrical shorts. Power terminals 111 are water cooled to keep them from overheating during the nitride heat treating process.

Figure 6:
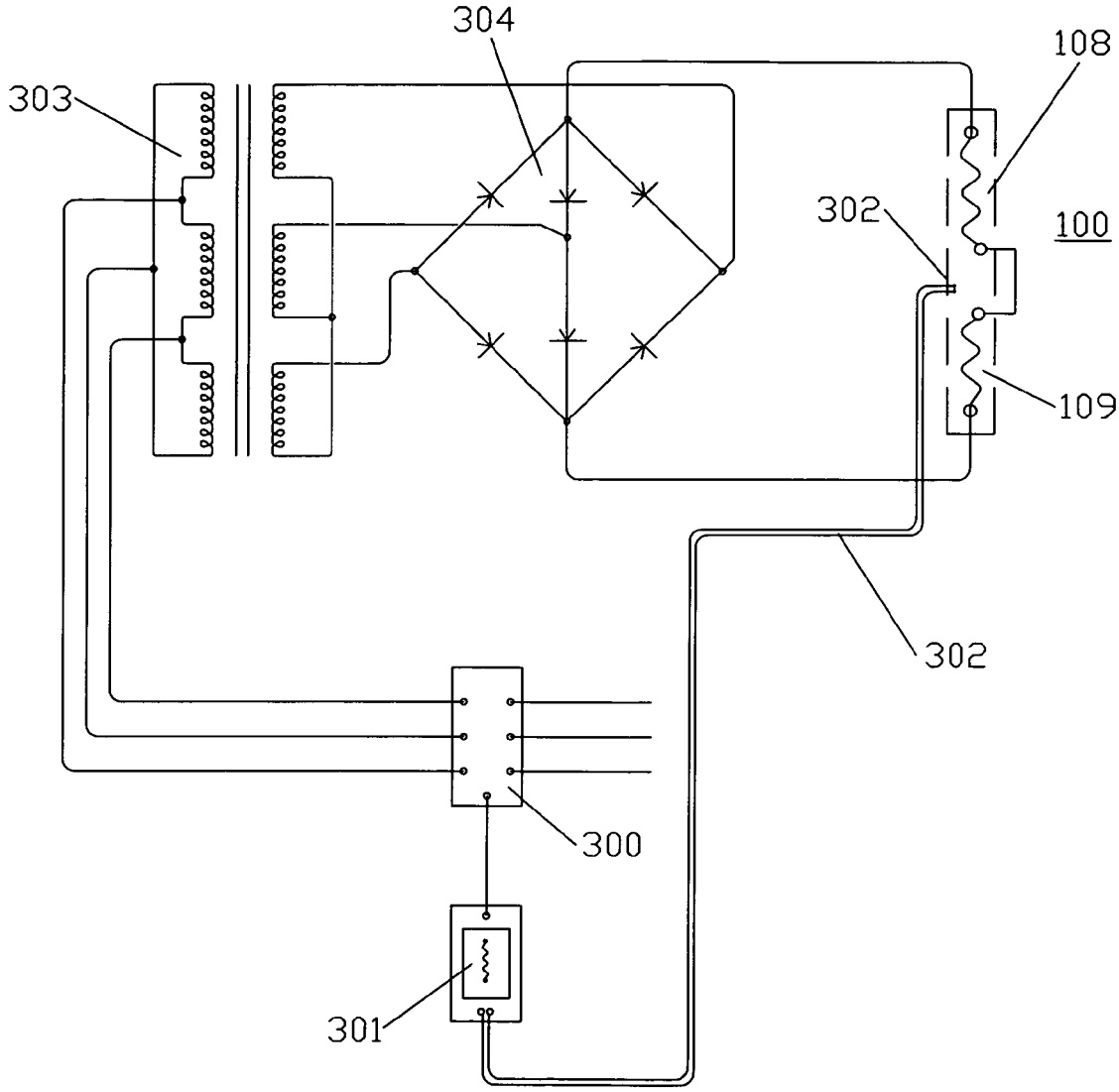
FIG. 6 depicts the balanced three phase power supply to the heating elements of furnace 100.

The two graphite heating element bands 108 and 109 are connected in series and are supplied with power from a DC rectifier bank, as illustrated in FIG. 6. The rectifier bank is connected in a three phase star arrangement for supplying balanced three phase power line operation. This power supply arrangement and its function will be described in greater detail in connection with FIG. 6 and the operation of the furnace.

Two graphite plates 113 and 114 are located in front of graphite heating elements 108 and 109, respectively, and another graphite plate 115 is located across the top of hot zone 106 below a pair of circulating fans 116 (one fan is shown) that are mounted in the top wall of hot zone 106. Circulating fans 116 each contain a radial fan wheel 117 made of graphite material and manufactured from a solid block of graphite. The grade of graphite material used for the radial fan wheel is preferably NAC-675 ISO molded graphite. These three graphite plates 113, 114 and 115 located in front of heating elements 108 and 109 and below circulating fans 116 are typically 5/16 inch thick, but could vary in thickness to accommodate different nitride heat treating requirements and furnace dimensions, and are preferably manufactured from type ATJ graphite. Graphite plates 113, 114 and 115, which surround the workload being nitride heat treated, act as a baffle or plenum 211 to provide uniform gas circulation during the nitride heat treating process. Graphite plate 115 is connected by supports 118 and 119 mounted in the top wall of hot zone 106 and has two openings 120 (one opening is shown) centered directly below each one of the fan wheels 117. Each opening 120 is typically 8 inches in diameter, but its dimensions may be varied to match the size of the fan wheels. A pair of circulating fan motors 121 (one motor is shown) are mounted externally from the inner top wall of hot zone 106 to prevent exposure to the hot reactive gases. Graphite baffles 113, 114 and 115 act as gas ducts to direct gas flow upward from the workload into the fan assembly and then radially outward through the plenum or baffle, providing recirculation toward graphite heating elements 108 and 109, and thereafter into the bottom of hot zone 106. As the hot ammonia gas circulates through hot zone 106, it interacts with the workload to dissociate the ammonia on the workload surface resulting in a nitrided case. Since there is no steel alloy within hot zone 106, the only place that the ammonia can dissociate is on the surface of the workload, making the present apparatus and process highly efficient and predictable, and using a minimum amount of ammonia. Due to the present unique design, there is virtually no leakage of the ammonia gas during the nitride heat treating process.

This structural arrangement is a significant improvement over furnaces described in the prior art, such as in publications EPO 754768, WO 2006/105899 and US 2006/0119021, and patent numbers GB 1277846 and U.S. Pat. No. 6,756,566. None of these prior art furnaces contain graphite baffle arrangements, as disclosed in the present invention, to provide uniform circulation of the hot reactive gasses. The absence of a baffle arrangement similar to the present invention results in non-uniform gas flow around the workload, and stagnant pockets of gas within the respective hot zones.

Figure 4:
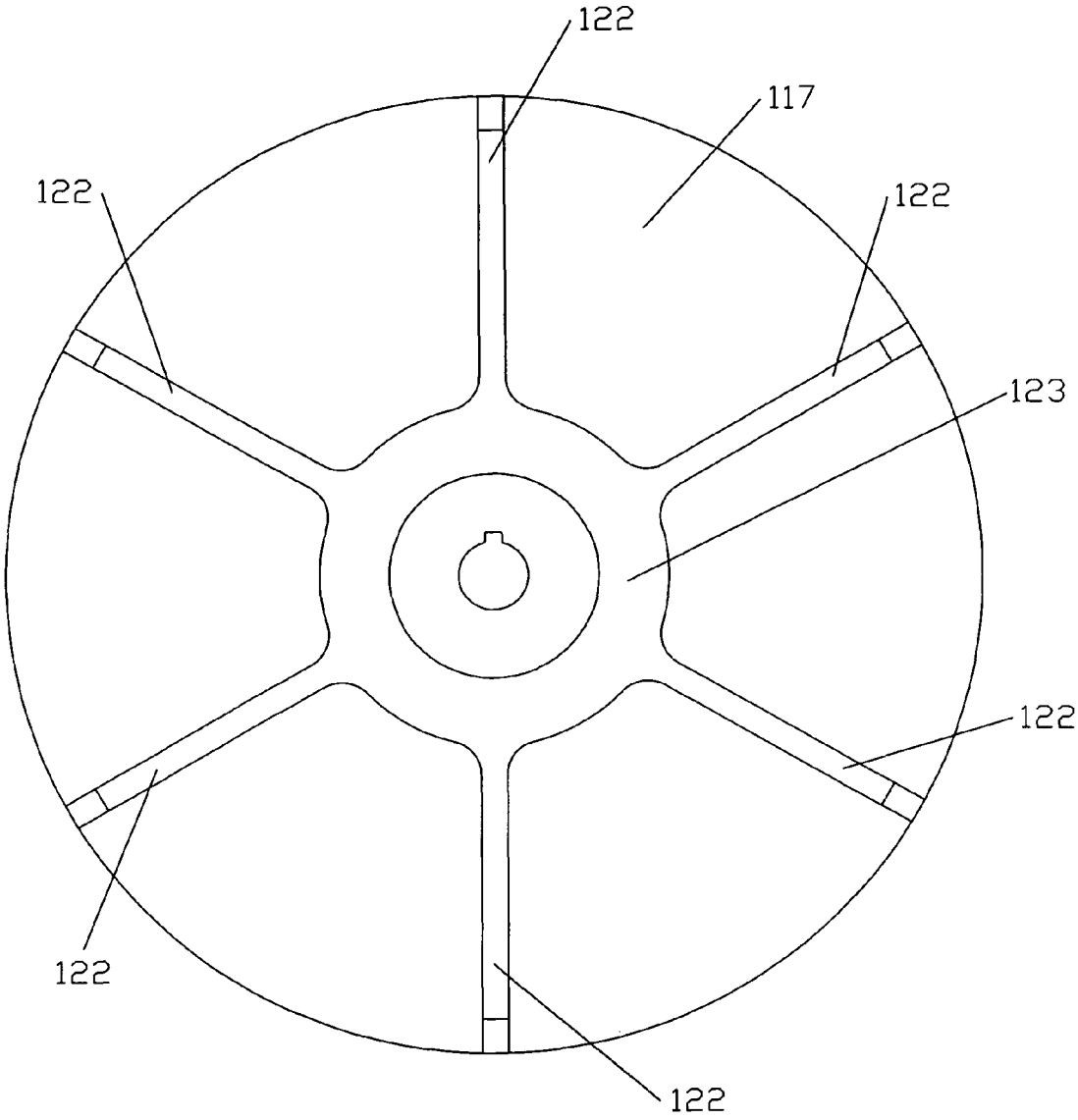
FIG. 4 depicts a front view of the radial recirculating fan in furnace 100.

Referring now to FIG. 4 there is shown a front view of radial fan wheel 117. Fan wheel 117 is preferably manufactured from a solid block of graphite—preferably Grade NAC-675 ISO Molded. Because of the corrosive nature of the ammonia gas used in the nitride case hardening process, graphite is the best choice of material for this component located within hot zone 106, as it is non-reactive with ammonia. The two 14 inch diameter fan wheels 117 utilize a reinforced radial wheel design having six straight blades 122 of 3/8 inch blade width extending in a radial direction from a central circular hub 123. The diameters of fan wheels 117 are larger than the diameters of openings 120 centered directly below each one of the fan wheels in order to assist with the flow of the nitriding gas. This arrangement prevents reverse flow back down into hot zone 106 and forces the flow radially around to heating elements 108 and 109. Fan wheels 117 are strategically located in the top front center and top rear center of the 48 inch deep dimension of the furnace chamber. These specially engineered wheels facilitate the convection heating within the furnace and continuous recirculation during nitride case hardening, and they assist in gas cooling of the workload in hot zone 106. The convection heating is performed at temperatures up to 1250° F., with the graphite radial fan wheels 117 rotating up to 1800 rpm. Fan motors 121 are typically and advantageously 3 hp vacuum sealed motors that operate from a variable speed drive. Motors 121 are mounted in vacuum tight, water cooled, o-ring sealed vacuum bells (not shown) mounted along the top of graphite insulation 210 surrounding hot zone 106. The motor assemblies and mounting arrangement are well known to those skilled in the art in the metal heat treating furnace industry.

The present furnace 100 is capable of heating a 2500 lb workload from ambient temperature to 900° F. in approximately sixty minutes, and cooling the workload from 900° F. to 200° F. in approximately sixty minutes. It is also capable of reducing atmospheric pressure in the furnace to one hundred microns in approximately thirty minutes utilizing the fans and baffle arrangement according to the present design.

The vacuum purge system used in the present vacuum nitriding furnace 100 allows for substantial evacuation of air from the furnace prior to heating the workload and introducing the nitride processing gas. In traditional atmospheric gas nitriding furnaces the removal of air from the furnace involves several fill/purge cycles using nitrogen or ammonia. After the fill/purge cycle, ammonia is introduced and heated to begin the nitriding process. All oxygen must be removed prior to heating because an ammonia/oxygen mixture is explosive at temperatures above 300° F. The use of a vacuum purge prior to heat up in the present furnace eliminates the need to repeatedly introduce and then exhaust expensive nitrogen gas at the beginning of the nitriding process cycle.

Figure 3:
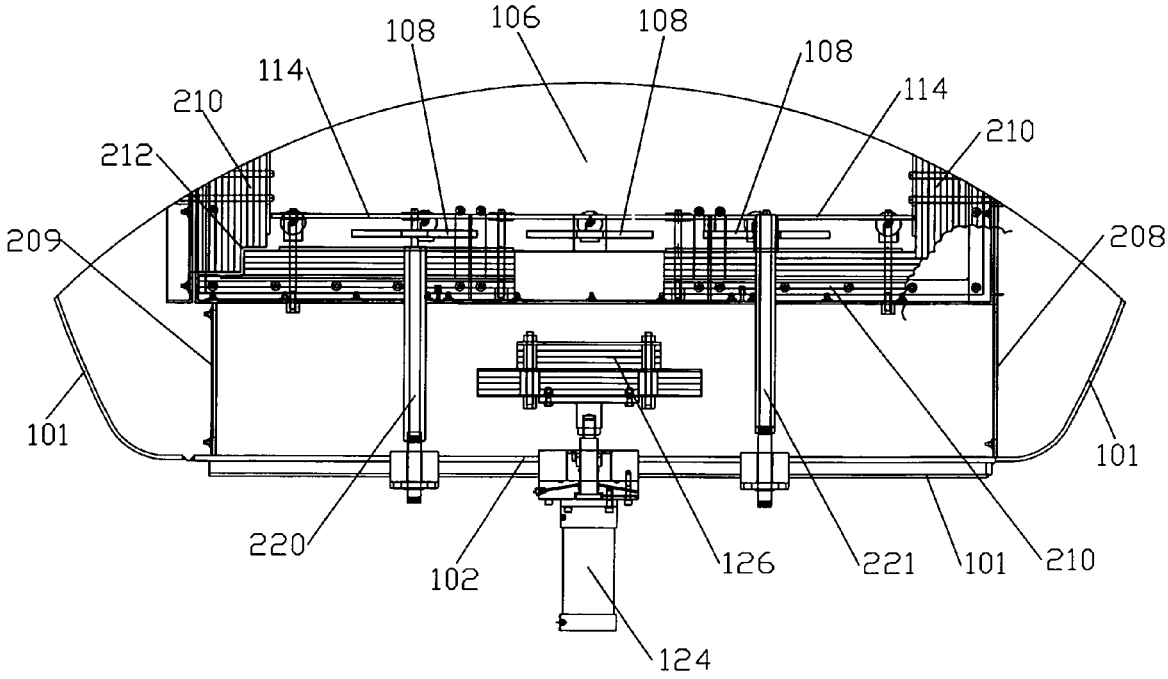
FIG. 3 depicts in partial cutaway a side cross-section view revealing features in the gas supply and port plug movement end of furnace 100.

As shown in FIGS. 1 and 3, furnace 100 includes a pair of piston driven port mechanisms 123 and 124 to provide a gas-tight seal during the heating cycle, in order to prevent loss of heat during the nitriding process. Mechanisms 123 and 124 each include port plugs 125 and 126 shown in the open position, respectively, and each port plug is operatively connected to its associated mechanism. Port plugs 125 and 126 are manufactured from graphite material making them non-reactive with the ammonia gas used in the nitriding process. Port plugs 125 and 126 fit tightly into gas port openings 127 and 128, respectively, in the adjoining graphite insulation 210 surrounding hot zone 106 when they are moved to the closed position. Port plugs 125 and 126 keep the nitriding gas within hot zone 106 and prevent leakage of the hot gas out to outer chamber 104. The port plugs also prevent the colder gas in outer chamber 104 from leaking into hot zone 106 causing heat loss in the hot zone and resulting in loss of temperature uniformity. This arrangement of components is an improvement over the flapper nozzle designs of prior art heat treating furnaces. After the nitriding process has been completed, port plugs 125 and 126 are opened by port mechanisms 123 and 124, respectively, and cooling gas (preferably nitrogen) is introduced through a backfill valve (not shown) into the furnace to rapidly cool the case hardened workload. Circulating fans 116 continue to run allowing the cooling gas to circulate upward from the workload and then radially outward and downward through the baffle or plenum conduit 211 formed by graphite plates 113, 114 and 115, and graphite heating elements 108 and 109. The cooling gas exits through gas port opening 127 and a cooling gas exit tube 132 to an external blower can 130, which will be described in greater detail in connection with FIG. 5.

Figure 5:
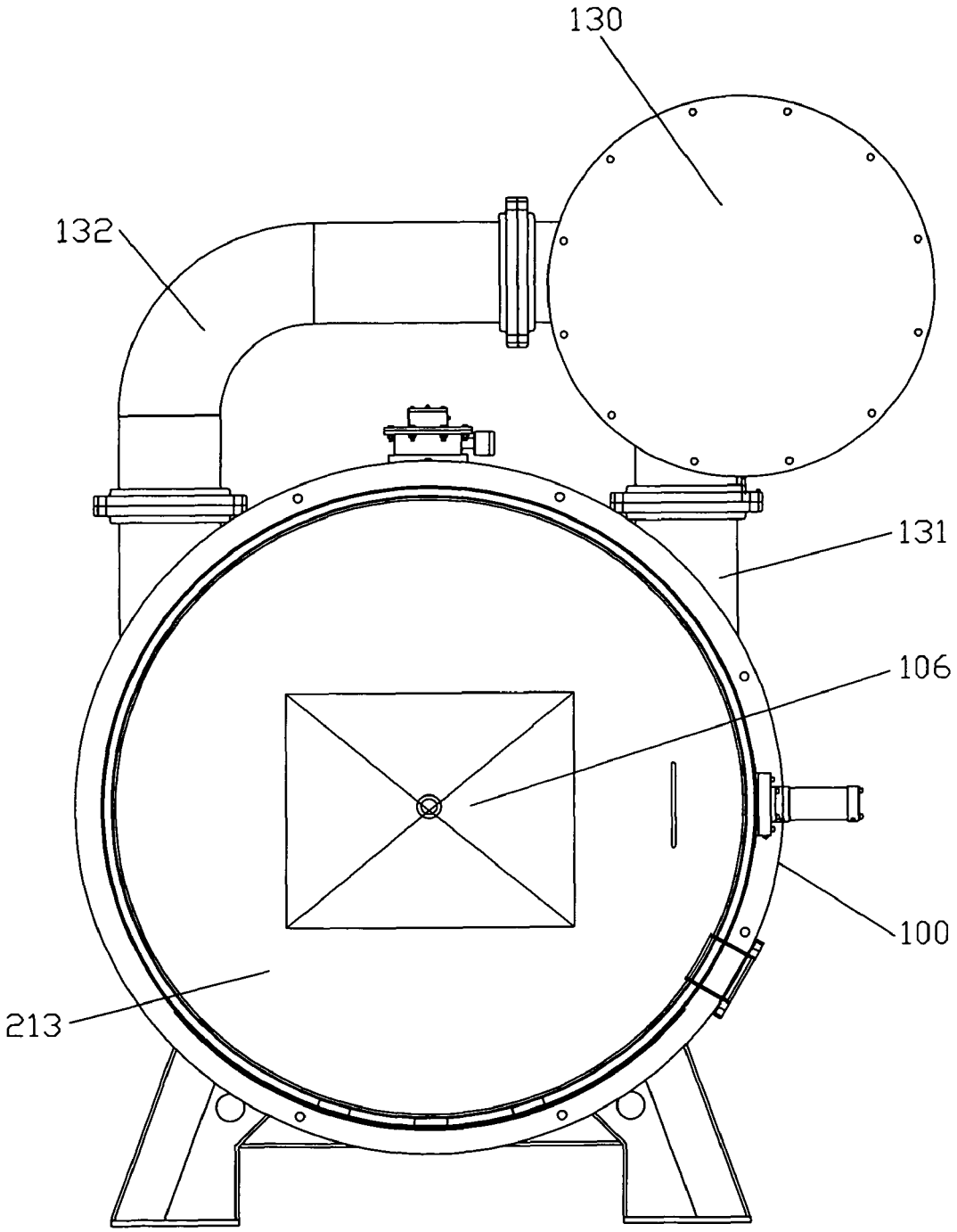
FIG. 5 depicts the external gas cooling arrangement of furnace 100.

The external gas cooling system shown in FIG. 5 includes blower can 130 containing a commercially available 30 hp motor and fan (not shown) for providing high velocity gas flow. The system further includes an all stainless steel, water cooled heat exchanger (not shown) and a blower assembly (not shown) which includes a computer balanced fan wheel. All of these components are readily available commercially and well known to those skilled in the metal heat treating furnace industry.

Referring now to FIG. 1 and FIG. 5, the hot gasses from the nitride heat treating cycle exit furnace 100 through opening 127 in graphite insulation 210 after port plug 125 is retracted from the opening by mechanism 123. The hot gasses then exit through tube 132 into the heat exchanger where they are cooled. The gasses then pass through the blower assembly in blower can 130 where they are forced out at high velocity and returned to opening 128 through entrance tube 131. After port plug 126 is retracted from opening 128 by mechanism 124, the cooled gas enters hot zone 106 to cool the nitride case hardened workload. This process is repeated continuously until the workload is cooled down to the desired temperature. The cooling system according to the present invention is capable of cooling a 2500 lb workload from 900° F. to 200° F. in approximately sixty minutes.

Referring to FIG. 6, the three phase balanced power supply to the vacuum nitriding furnace will now be described. A 460 volts alternating current (AC) balanced load from a three phase power line is fed to a silicon controlled rectifier (SCR) 300, which acts as a power controller. In response to a 4 to 20 milliampere signal from a temperature controller/programmer 301, which receives a generated millivolt analog signal from a type K thermocouple 302 inserted inside of the furnace hot zone 106 chamber and positioned adjacent to one of the heating element 108 or 109, the SCR power controller 300 provides a proportional voltage supply (0 to 460 volts) to a three phase step-down transformer 303. The input side of transformer 303 is a delta connection, while the output side is a wye connection. Transformer 303 decreases the voltage by an approximate ratio of 4.6:1, and inversely increases the current. The AC power, which has been converted as described to this point, is essentially maintained in a balanced relationship across the three phase power line. The approximately 100 volt three phase AC power output from transformer 303 then enters a three phase bridge rectifier bank 304 where it is converted to a single phase direct current (DC) power source of approximately 100 volts. This power source is connected via power cables to the two 50 volt graphite heating element banks 108 and 109 connected in series. Thus, employing the three phase bridge rectifier 304 in the design according to the present invention results in a reduced number of heavy duty copper power cables required, and also in the desirable balanced three phase power input to the furnace power supply.

Having described the novel vacuum nitriding furnace apparatus, a typical nitride heat treating process cycle will now be described. Workloads to be nitride case hardened are either placed directly into furnace 100 or in alloy steel baskets which are then placed in the furnace on graphite hearth rails 222. The steel baskets will not adversely affect the process and may serve as a catalyst for dissociation of the ammonia gas on the workload. Hearth rails 222 are capable of supporting up to 2500 lbs. The furnace door (not shown) is then closed, and gas port plugs 125 and 126 are closed to seal furnace 100 from leakage of gas. Furnace outer chamber 104 and hot zone 106 are evacuated by means of a suitable vacuum pump (not shown) to a set pressure—preferably $10^{-2}$ torr—to remove substantially all air from the furnace. The furnace is then backfilled with nitrogen to approximately +1 psig (800 torr) via a backfill valve (not shown). Partial pressure nitrogen is then introduced through gas inlet 220. Gas circulating fans 116 are turned on and the furnace is heated to a set nitriding temperature of approximately 900° F. to 1050° F., but may be as high as 1400° F. When the set temperature has been reached, a portion of the nitrogen gas is pumped out by the vacuum pump (not shown) to a set pressure below 800 torr. Ammonia is backfilled via the backfill valve to a set furnace pressure of 800 torr. Partial pressure ammonia is then continuously introduced along with partial pressure nitrogen via gas inlet 220. A separate main vent valve (not shown) removes spent process gas from the furnace when the furnace pressure exceeds 800 torr. Flow controllers (not shown) are set to continue to flow at a fixed ammonia to nitrogen ratio as required by the dissociation specifications into hot zone 106 via gas inlet 220. The ratio can range anywhere from 100% ammonia to 1% ammonia/99% nitrogen. This ratio is chosen in order to result in required dissociation rates set by the user. The gas moves upward toward openings 120 and circulating fans 116, which disperse the heated gas in a radial direction over graphite baffle plate 115 at right angles toward graphite baffle plates 113 and 114 through conduits 211 to the bottom of hot zone 106 and back upward through the workload. Gas is removed from hot zone 106 through a gas exit pipe 221, which extends directly into hot zone 106 and is fed into a nitriding gas analyzer (not shown), to determine the composition of the gas and to control the nitriding process in response to the results of the gas analysis.

When the nitriding process cycle has been completed, the heat and ammonia flow are shut off and then the furnace is pumped down to a pressure of approximately 1 torr to remove the unreacted ammonia, nitrogen and dissociated ammonia consisting of hydrogen and nitrogen. Once the desired pressure is reached, the furnace is backfilled with nitrogen to a pressure range of approximately 633 torr to 1520 torr, and preferably 1010 torr. The gas port plugs 125 and 126 are opened by mechanisms 123 and 124, respectively, and the blower fan (not shown) and circulating fans 116 are turned on to provide gas cooling of the workload. The warm gas exits via gas exit tube 132 into the external blower can 130, is cooled by the heat exchanger, and the cooled gas is returned to the furnace via gas entrance tube 131. This cooling process is continued until the workload has reached the desired set temperature.

The benefits of the vacuum nitriding furnace according to the present invention will now be summarized. There is no steel alloy retort or other steel alloy components within the present furnace hot zone, which contains all graphite materials. The present configuration of graphite insulation, graphite heating elements and graphite plates (baffles) forming a conduit therebetween, and graphite radial fan wheels result in a highly efficient, temperature controlled nitriding process. The present furnace configuration provides a highly energy efficient hot zone that results in a low watt density value on the order of 1 watt/sq. in. or lower under nitriding conditions. This is due to the hot zone being completely sealed from leakage into and out of it, and the use of high efficiency multiple layers of graphite felt insulation. As a result of no steel alloy being used within the hot zone, the present furnace uses approximately 90% less ammonia during the nitriding process. Standard prior art nitriding furnaces use approximately 1200 cu. ft./hr. of ammonia flow to reach required ammonia dissociation rates for processing, while the present furnace uses less than 100 cu. ft./hr. of ammonia flow. This extremely large difference in the amount of ammonia used results in significant benefits and cost savings. Environmentally, there is less discharge of ammonia gas into the atmosphere for each nitriding process cycle. Financially, there is less maintenance required of furnace parts used in prior art nitriding furnace retorts, such as nickel/chrome alloy parts, which become nitrided over time and have to be sand-blasted to remove the nitriding case that is built up. Cooling of the nitrided workload is much faster in the present furnace due to the combination of the external stainless steel heat exchanger and blower, along with the internal radial design graphite fan wheels which cool the hot zone faster and produce faster overall cycle times for nitriding workloads. Faster heating and cooling is also inherently achieved by virtue of the lower mass of graphite components used in the present furnace as compared with the nickel alloy components used in the retorts of prior art nitriding furnaces.

While there has been described what is believed to be a preferred embodiment of the invention, those skilled in the art will recognize that other and further modifications may be made thereto without departing from the spirit and scope of the invention. It is therefore intended to claim all such embodiments that fall within the true scope of the invention.

What is claimed is:

1. A vacuum heat treating furnace for nitride case hardening and gas cooling a stationary workload in the same furnace, comprising a single chamber and access means, said chamber being segregated into an outer portion and an inner portion, said inner portion of said chamber being adapted to receive the workload to be nitride case hardened through said access means and further being surrounded by graphite insulation means to retain gas used to nitride case harden the workload, said inner portion further including a plurality of graphite resistance heating elements and a plurality of graphite plates juxtaposed in near proximity to said graphite resistance heating elements forming a conduit therebetween, said inner portion further including fan assembly means adapted to circulate the nitriding gas within said inner portion and through said conduit to provide uniform nitride case hardening of the workload, and said outer portion of said chamber including port means for sealing in the hot nitriding gas from escaping from said inner portion of said chamber during the nitride case hardening heat treating cycle, and for sealing out any cooler gases from said outer portion during the nitride case hardening heat treating cycle.

2. A vacuum heat treating furnace in accordance with claim 1 wherein the gas used to nitride case harden the workload is anhydrous ammonia, said ammonia being reactive with the workload material.

3. A vacuum heat treating furnace in accordance with claim 1 wherein said port means includes a port plug and means for moving said port plug into and out of engagement with said inner portion of said chamber.

4. A vacuum heat treating furnace in accordance with claim 3 wherein said port plug is graphite.

5. A vacuum heat treating furnace in accordance with claim 1 wherein said port means includes a pair of port plugs and means for moving said port plugs into and out of engagement with said inner portion of said chamber.

6. A vacuum heat treating furnace in accordance with claim 5 wherein said port plugs are graphite.

7. A vacuum heat treating furnace in accordance with claim 1 wherein the furnace is capable of maintaining vacuum pressures down to approximately $10^{-2}$ torr and maintaining positive pressures up to at least approximately 100 torr during the nitride case hardening heat treating cycle.

8. A vacuum heat treating furnace in accordance with claim 1 wherein said fan assembly means includes a radial fan wheel in said chamber inner portion.

9. A vacuum heat treating furnace in accordance with claim 8 wherein said radial fan wheel is graphite.

10. A vacuum heat treating furnace in accordance with claim 1 wherein said graphite insulation means surrounding said inner portion is formed from a plurality of layers of high purity graphite felt insulation.

11. A vacuum heat treating furnace in accordance with claim 1 wherein said furnace inner portion configuration results in an energy efficient process having a low watt density value on the order of approximately 1 watt/sq. in. under nitriding conditions.

12. A vacuum heat treating furnace in accordance with claim 1 wherein said graphite resistance heating elements are direct current heating elements and the voltage thereto is rectified by a three phase bridge rectifier and a three phase power transformer to provide a balanced three phase load across the input power line.

13. A vacuum heat treating furnace in accordance with claim 1 wherein said furnace further includes external fan assembly means and external heat exchanger means, and wherein said port means are opened after the nitride case hardening heat treating cycle has been completed and said external fan assembly means and said external heat exchanger means are activated to provide gas cooling of the workload in said chamber until the workload has reached the desired set temperature.

* * * * *